US007111475B2

(12) United States Patent
Jung et al.

(10) Patent No.: US 7,111,475 B2
(45) Date of Patent: Sep. 26, 2006

(54) PIPE STRUCTURE OF AIR CONDITIONER

(75) Inventors: In Hwa Jung, Seoul (KR); Jung Woo Lee, Seoul (KR); Seong Won Bae, Seoul (KR); Sim Won Chin, Gwangmyeong-si (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/914,080

(22) Filed: Aug. 10, 2004

(65) Prior Publication Data

US 2005/0166623 A1 Aug. 4, 2005

(30) Foreign Application Priority Data

Jan. 29, 2004 (KR) ..... 10-2004-0005810

(51) Int. Cl.
*F25B 39/04* (2006.01)

(52) U.S. Cl. ..... 62/428; 62/507

(58) Field of Classification Search ..... 62/428–429, 62/506–508

See application file for complete search history.

(56) References Cited

U.S. PATENT DOCUMENTS

| | | | | |
|---|---|---|---|---|
| 3,785,168 | A * | 1/1974 | Domingorene | 62/455 |
| 4,321,803 | A * | 3/1982 | Smith | 62/507 |
| 4,555,915 | A * | 12/1985 | Dasher | 62/448 |
| 5,775,120 | A * | 7/1998 | Inazuka et al. | 62/259.1 |
| 2005/0076663 | A1* | 4/2005 | Goodman | 62/298 |
| 2005/0144975 | A1* | 7/2005 | Fuchikami et al. | 62/508 |

FOREIGN PATENT DOCUMENTS

| | | |
|---|---|---|
| CN | 2348286 | 11/1999 |
| JP | 3-267637 | 11/1991 |

* cited by examiner

*Primary Examiner*—William E. Tapolcai
(74) *Attorney, Agent, or Firm*—Greenblum & Bernstein, P.L.C.

(57) ABSTRACT

A pipe structure of an air conditioner, wherein the pipes inside the machinery room are concentrated on one side of the compressor to form long up-down direction so that the pipes inside the machinery room of the air conditioner may be formed in a compact manner, is provided.

8 Claims, 3 Drawing Sheets

PIPE STRUCTURE OF AIR CONDITIONER

BACKGROUND OF THE INVENTION

1. Field of the Invention

The present invention relates to a pipe structure of an air conditioner, and more particularly, to a pipe structure of an air conditioner that can reduce vibration from an absorption/discharging pipe of a compressor, and from a plurality of connection pipes, which are neighboring pipes around the compressor, among elements of an outdoor unit. Also, the present invention relates to a pipe structure of an air conditioner that can maintain, in a more compact form, a structure of a machinery room where the compressor is located.

2. Description of the Related Art

Generally, an air conditioner is an apparatus for controlling temperature and/or humidity of a system desired by a user, by circulating, inside the system, a cooling air generated through compression, condensation, expansion, and evaporation of refrigerant.

Such an air conditioner includes an indoor unit positioned in an indoor and an outdoor unit positioned in an outdoor, for emitting undesired heat or a cooling air. In the meantime, to the inside of the outdoor unit, an outdoor heat exchanger for exchanging heat, an outdoor fan for generating forced wind tunnel, and a compressor for forcibly flowing a refrigerant inside a cooling cycle, are generally provided. Since generating a noise during its operation, the compressor is generally positioned in the outdoor unit so that noise environment in the indoor may be improved.

However, recently, as the space of the indoor environment gets narrow, the indoor space gets close to the installation position of the outdoor unit and noise from the outdoor unit is frequently transferred to the indoor space. Under such an environment, an effort to reduce the noise occurring during operation of the outdoor unit is being made. Particularly, in case the outdoor unit and the indoor unit are positioned inside the same apparatus such as a window-type air conditioner, the problem related to the noise is caused more seriously.

In the meantime, the noise from the outdoor unit is roughly divided into a noise occurring during operation of the outdoor fan and a noise occurring during operation of the compressor. The present invention is mainly directed to improve the noise occurring during operation of the compressor. Generally, the noise occurring at the compressor is transferred through a pipe. More specifically, vibration occurring at the compressor is transferred through the absorption and the discharging pipes connected to the compressor and a plurality of connection pipes formed inside the machinery room, and amplified by mutual interference, and changed into big vibration and noise in case vibration reaches resonance.

According to the related art, a plurality of pipes formed in the machinery room where the compressor is located, is generally formed long to reduce vibration from the compressor. Also, in order for the long pipes to be formed inside the machinery room, a plurality of pipes are mutually twisted in a three-dimensional structure. Therefore, it is frequent that the mutually connected pipes are mutually amplified in their vibration and that resonance is generated in the whole pipe due to mutual three-dimensional influence given and taken between them, which have been problematic. If resonance is generated in the pipe, trembling is generated in the whole pipe, which becomes a factor for generating a noise in the whole machinery room.

Also, if the pipes are twisted disorderly, the structure of the machinery room becomes complicated and the space of the machinery room cannot be used efficiently.

SUMMARY OF THE INVENTION

Accordingly, the present invention is directed to a pipe structure of an air conditioner that substantially obviate one or more problems due to limitations and disadvantages of the related art.

An object of the present invention is to provide a pipe structure of an air conditioner that can minimize influence given and taken between the pipes.

Another object of the present invention is to provide a pipe structure of an air conditioner that can prevent vibration, resonance, and noise of pipes due to vibration from a compressor by reducing vibration transferred from the compressor to the pipes.

A further object of the present invention is to provide a pipe structure of an air conditioner that can construct a structure of the machinery room of the outdoor unit in a more compact manner.

To achieve these objects and other advantages in accordance with the purpose of the invention, as embodied and broadly described herein, there is provided a pipe structure of an air conditioner, including: an outdoor unit of an air conditioner; a machinery room formed on either side inside the outdoor unit; a compressor formed inside the machinery room, for compressing a refrigerant; and a plurality of pipes formed, in parallel with each other, radially from the compressor and which are a flowing path of a refrigerant passing through the compressor and formed long in up-down direction at the outer side of the compressor.

At this point, supposing that a distance between one pipe and an adjacent other pipe among the above pipes, is a P-dist and a radius of the pipe is R, a condition of $4R<P\text{-dist}<10R$ is satisfied.

At this point, supposing that an intervening angle between one pipe and an adjacent other pipe among the above pipes is a P-angle and a radius of the pipe is R, a condition of $135°<P\text{-angle}<225°$ is satisfied.

In another aspect of the present invention, there is provided a pipe structure of an air conditioner, including: a barrier for partitioning an outdoor unit of an air conditioner and has a machinery room in its part of the division; a compressor settled down inside the barrier; and a plurality of pipes which is a flowing path of a refrigerant passing through the compressor and formed long in up-down direction at an outer side of the compressor and concentrated on one side of the compressor, so that an inside of the machinery room may be formed in a compact manner.

In still another aspect of the present invention, there is provided a pipe structure of an air conditioner, including: a compressor; and a plurality of pipes formed vertically, in parallel with each other, with the compressor centered and which are a flowing path of a refrigerant passing through the compressor and formed long in up-down direction at the outer side of the compressor.

According to the pipe structure of the air conditioner of the present invention, an effect of reducing vibration and noise generated at the machinery room of the outdoor unit, can be obtained. Also, since the pipes can be concentrated on a narrow space, the machinery room can be small-sized.

Also, since a single-type vibration reducing member can be installed, in a simple manner, at the pipe structure of the present invention, the manufacturing process of the outdoor unit can be simplified and the manufacturing costs can be reduced.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings.

Figure 1:
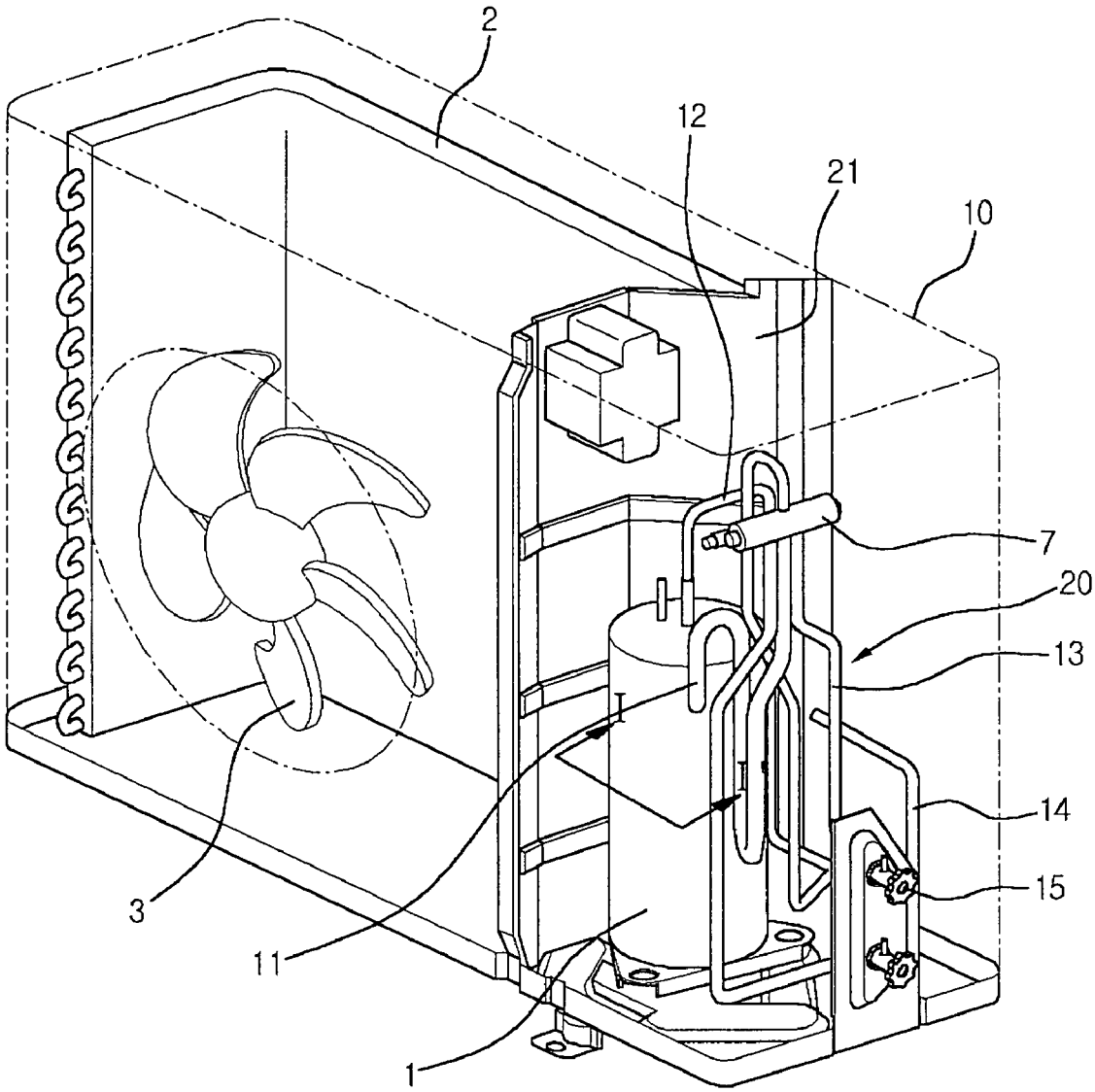
FIG. 1 is a perspective view of an outdoor unit according to the present invention.

FIG. 1 is a perspective view of an outdoor unit according to the present invention.

Referring to FIG. 1, it is seen that for the inner construction of the outdoor unit, a compressor 1, an outdoor heat exchanger 2, an outdoor fan 3, a four-way valve 7, an absorption pipe 11, a discharging pipe 12, an indoor-connection pipe 13, and an outdoor-connection pipe 14, are provided. More specifically, there are provided the compressor 1 for compressing a refrigerant, the outdoor heat exchanger 2 for performing heat exchange in the outside, the outdoor fan 3 for exerting a forcible wind tunnel on the outdoor heat exchanger 2, and the four-way valve 7 for switching flowing direction of a refrigerant in a forward or a reverse direction inside the cooling cycle, so that the cooling cycle is switched into an air conditioning cycle or a heat pump cycle. Also, there are provided the absorption pipe 11 for connecting the four-way valve 7 with an absorption side of the compressor 1, the discharging pipe 12 for connecting the four-way valve 7 with a discharging side of the compressor 1, the indoor-connection pipe 13 for connecting the four-way valve 7 with a service value 15, and the outdoor-connection pipe 14 for connecting the four-way valve 7 with the outdoor heat exchanger 2.

Also, there are provided a case 10 constituting an appearance of the outdoor unit, and a machinery room 20 where the compressor 1 and the pipes are located and formed on either side of the outdoor unit. The machinery room 20 is locally biased on either side of the outdoor unit and separated, by means of the barrier 21, from the space where the outdoor fan 3 and the outdoor heat exchanger 2 are installed.

With priority given to the four-way valve, flowing of a refrigerant inside the pipe in the outdoor unit will be briefly described in the following. Flowing direction of a refrigerant inside the absorption pipe 11, the discharging pipe 12, the indoor-connection pipe 13, and the outdoor-connection pipe 14, can be controlled by the four-way valve 7. More specifically, if the discharging pipe 12 is connected with the outdoor-connection pipe 14 and the absorption pipe 11 is connected with the indoor-connection pipe 13, the air conditioner operates as the general air conditioner for cooling down the inside. On the contrary, if the discharging pipe 12 is connected with the indoor-connection pipe 13 and the absorption pipe 11 is connected with the outdoor-connection pipe 14, the air conditioner operates as the heat pump for heating the inside.

Also, on the part where the indoor-connection pipe 13 is projected, in its end, to the outside of the outdoor unit, a service valve 15 is formed. The service value 15 may be used for vacuum-forming of the inside of the pipe, temporarily stopping the air conditioner system, and discharging/injecting a refrigerant. Such service valve 15 is projected on the outside of the outdoor unit case 10.

In the meantime, referring to FIG. 1, it is seen that most of pipes including the absorption pipe 11, the discharging pipe 12, the indoor-connection pipe 13, and the outdoor-connection pipe 14, are formed in parallel with each other, in up-down direction, at a position adjacent to the compressor 1. Also, it is seen that a plurality of pipes formed at the position adjacent to the compressor 1 is concentrated each other on one part. In addition, though not shown in the drawing, since a single shaped member can be used for the vibration reducing member in case the pipes are concentrated on a predetermined position, the manufacturing process of the outdoor unit can be simplified.

In the meantime, though the pipes 11, 12, 13 and 14 are formed on the right side of the compressor 1, same effect can be expected even in case the pipes are formed on the left side of the compressor 1.

Figure 2:
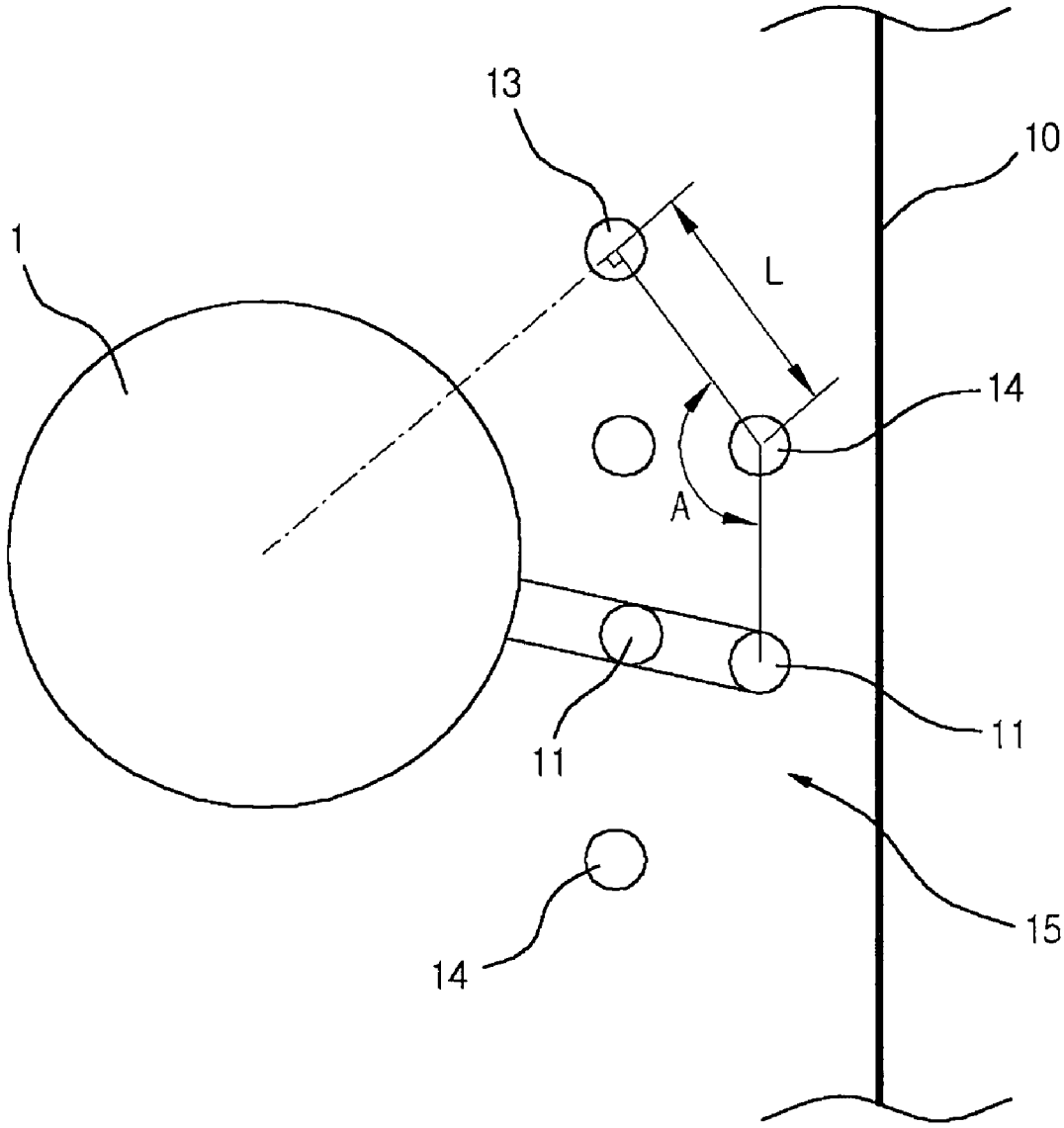
FIG. 2 is a cross-sectional view taken along line I–I' of FIG. 1.

FIG. 2 is a cross-sectional view taken along line I–I' of FIG. 1.

In FIG. 2, it is seen that the compressor 1 and the pipes 11, 12, 13 and 14 in the neighborhood of the compressor 1 are arranged. Since the pipes are concentrated radially on either side of the compressor, the machinery room can be used in a more efficient manner and in the drawing, the pipes are formed long in up-down direction at the right of the compressor 1. According to the other aspect of the present invention, any one pipe is formed long, in up-down direction, at the position adjacent to the position facing a virtual connection line for connecting other pipes adjacent to both sides of the pipe. Also, according to another aspect of the present invention, to increase concentration efficiency of the pipe, the pipes are arranged in an approximately circular shape around the compressor 1.

Also, since the pipes are formed in a direction parallel with the longitudinal direction of the compressor 1, namely, formed long, in up-down direction, on a two-dimensional basis, the inside of the machinery room 20 can be used in a more efficient manner. Furthermore, since the pipes 11, 12, 13 and 14 are formed long each other in parallel direction, the vibration reducing member may be formed in form of a single-type body at once. Also, since the pipes 11, 12, 13 and 14 are formed long in parallel direction to one another, it is expected that vibrations that might mutually influence on the pipes are reduced more easily.

In the meantime, the present invention suggests a primary factor by which the pipes 11, 12, 13 and 14 are installed, as follows. More specifically, with assumption that a plurality of pipes of various kinds is formed long vertically, at either side of the compressor, the present invention suggests a desirable proposal for a distance between the pipes and an intervening angle between the pipes.

Defining a distance L between the pipes 11, 12, 13 and 14 as a P-dist, the P-dist is given by the following formula 1.

Formula 1

4R<P-dist<10R (Here, R represents a radius of the pipe)

If the distance between the pipes 11, 12, 13 and 14 is too short, the pipes collide with each other upon occurrence of vibration, so that a noise may be generated. Even though the vibration reducing member (not shown) is installed, there is possibility that vibration between the pipes may not be reduced sufficiently. Also, if the distance between the pipes is too long, there are weak points that space use efficiency of the machinery room is decreased and that a single vibration reducing member cannot be installed. For the vibration reducing member, a variety of shapes such as a rubber, a tape is possibly used.

Defining an intervening angle A between the pipes 11, 12, 13 and 14, as a P-angle, the P-angle is given by the following formula 2.

135°<P-angle<225°

As described above, in case the intervening angle between the pipes 11, 12, 13 and 14 is too big, there is a weak point that concentration degree of the pipes is lowered so that space use efficiency of the machinery room is reduced. On the contrary, in case the intervening angle is too small, there is a weak point that the pipes get too close each other so that mutual interference might be generated between the pipes.

More preferably, it is possible to reduce vibration of the pipes while increasing concentration degree of the pipes, by having a virtual line linking the compressor 1 to one of the pipes 11, 12, 13 and 14, perpendicular to a virtual line linking the spaces between the pipes 11, 12, 13 and 14. Since there is no possibility that a vibration component provided to one of the pipes 11, 12, 13 and 14 is amplified by the adjacent other pipe thanks to the orthogonality relation between such virtual lines, mutual interference of vibration can be avoided and reduction effect in vibration can be obtained on the whole.

In the meantime, referring to FIG. 2, it is shown that pipes of one kind are positioned between pipes of other kind. By such mutual arrangement relation of the pipes, it is possible to prevent a vibration component occurring at one of the pipes from being amplified by mutual interference with the vibration component of the adjacent other pipe. More specifically, it is easily estimated that the vibration component occurring at one of the pipes is different from the vibration component occurring at other pipe. Therefore, by having other pipe positioned at the adjacent position of one of the pipes, it is possible to have the vibrations not interfered each other. For example, the outdoor-connection pipe 14 is positioned between the absorption pipe 11 and the indoor-connection pipe 13.

Also, as explained above, by having another pipe positioned at the position between the two pipes, i.e., at the adjacent position on a connection line connecting the two pipes, the pipes can be arranged, two-dimensionally, in a parallel direction, whereby reduction effect of the vibration can be enhanced even more. It is needless to say that the pipes are arranged side by side at the adjacent position so that a single-type vibration reducing member may be easily installed.

In the meantime, though a plurality of pipes 11, 12, 13 and 14 is circularly arranged in FIG. 2, same effect can be obtained even in case the pipes are arranged in a straight line.

Figure 3:
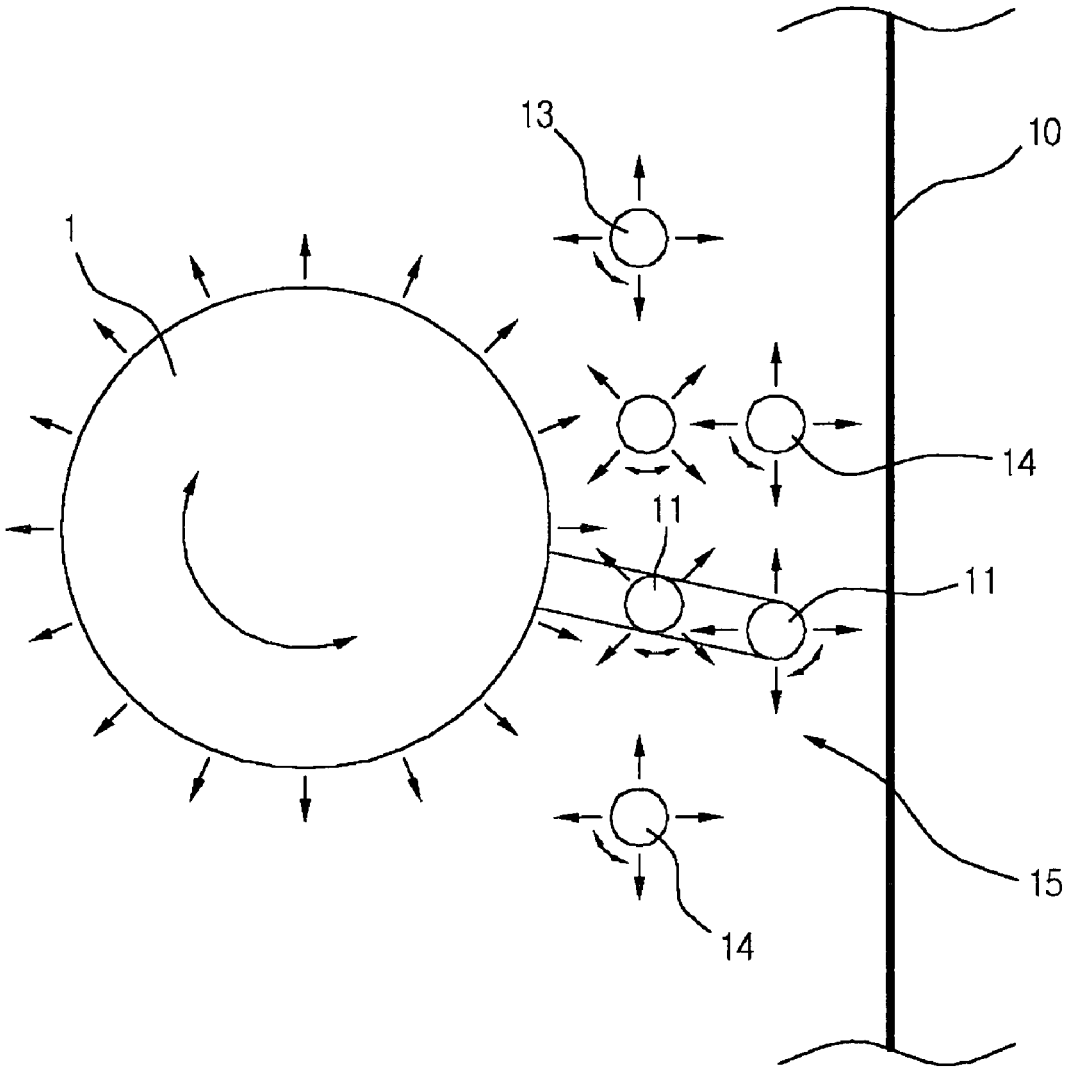
FIG. 3 is a drawing explaining operation of the present invention.

FIG. 3 is a drawing explaining operation of the present invention.

Referring to FIG. 3, as described above, if the compressor 1 operates, rotational vibration or vibration in right-left direction is generated at the compressor 1 by a rotor (not shown) rotating inside the compressor 1. The vibration of the compressor 1 is transferred through the absorption pipe 11 and the discharging pipe 12 connected to the absorption and the discharging sides of the compressor 1, respectively, and finally propagated to the connection pipes 13 and 14 by way of peripheral devices of the compressor 1, so that the whole pipes are under influence of the compressor's vibration.

At this point, since a plurality of pipes positioned at the neighborhood of the compressor 1, is aligned in parallel direction each other and formed radially around the compressor 1, the vibrations generated at one of the pipes and the adjacent other pipe can be cancelled each other.

Such a pipe structure of the air conditioner can be applied not only to an outdoor unit of a heat pump, general heating/cooling system, but also to an outdoor unit of an air conditioner for cooling operation, an outdoor unit of a multi-type air conditioner, and an outdoor unit of an air conditioner having an accumulator as well.

According to the suggested pipe structure of the air conditioner, an effect that the vibration and noise generated from the machinery room of the outdoor unit are reduced even more can be obtained. Also, since the pipes can be arranged, in a concentrating manner, at a narrow space, the machinery room can be small-sized. Also, inside the small-sized machinery room, sound absorbing material can be installed in a more convenient manner.

Also, since a singe-type vibrating reducing member can be installed at the pipe structure in a simple manner, the manufacturing process of the outdoor unit can be simplified and the manufacturing costs can be reduced.

It will be apparent to those skilled in the art that various modifications and variations can be made in the present invention. Thus, it is intended that the present invention covers the modifications and variations of this invention provided they come within the scope of the appended claims and their equivalents.

What is claimed is:

1. A pipe structure of an air conditioner, comprising:

an outdoor unit of the air conditioner;

a machinery compartment formed on either side inside the outdoor unit;

a compressor provided inside of the machinery compartment to compress a refrigerant; and a plurality of pipes provided in parallel with each other, extending radially from the compressor to provide a flow path of the refrigerant passing through the compressor and extending generally vertically at an outer side of the compressor, wherein assuming that a distance between one pipe and an adjacent other pipe among the pipes, is a P-dist and a radius of the pipe is R, a condition of 4R<P-dist<10R is satisfied.

2. The pipe structure according to claim 1, wherein assuming that an intervening angle between one pipe and an adjacent other pipe among the pipes is a P-angle and a radius of the pipe is R, a condition of 135°<P-angle<225° is satisfied.

3. The pipe structure according to claim 1, wherein the pipes comprise an outdoor-connection pipe to connect a four-way valve with an outdoor heat exchanger, and an indoor-connection pipe to connect the four-way valve with a service valve.

4. A pipe structure of an air conditioner, comprising:

a barrier that partitions an outdoor unit of the air conditioner to provide a machinery compartment;

a compressor provided on one side of the barrier; and a plurality of pipes providing a flow path of a refrigerant passing through the compressor and extending generally vertically at an outer side of the compressor and concentrated on one side of the compressor, so that an inside of the machinery compartment may be formed in a compact manner, wherein the pipes include at least one absorption pipe through which a refrigerant is absorbed to a compressor side, a discharging pipe to which a refrigerant is discharged, an indoor-connection pipe to connect a four-way valve with a service valve, and an outdoor-connection pipe to connect the four-way valve with an outdoor heat exchanger.

5. The pipe structure according to claim 4, wherein assuming that a distance between one pipe and an adjacent other pipe among the pipes, is a P-dist and a radius of the pipe is R, a condition of 4R<P-dist<10R is satisfied.

6. The pipe structure according to claim 4, wherein assuming that an intervening angle between one pipe and an adjacent other pipe among the pipes is a P-angle and a radius of the pipe is R, a condition of 135°<P-angle<225° is satisfied.

7. A pipe structure of an air conditioner, comprising:

a compressor; and a plurality of pipes formed to extend generally vertically, in parallel with each other, with the compressor centered, the pipes providing a flow path of a refrigerant passing through the compressor and formed at an outer side of the compressor, wherein assuming that a distance between one pipe and an adjacent other pipe among the pipes, is a P-dist and a radius of the pipe is R, a condition of 4R<P-dist<10R is satisfied.

8. The pipe structure according to claim 7, wherein assuming that an intervening angle between one pipe and an adjacent other pipe among the pipes is a P-angle and a radius of the pipe is R, a condition of 135°<P-angle<225° is satisfied.

* * * * *